US006148916A

United States Patent [19]

Sampson et al.

[11] Patent Number: 6,148,916

[45] Date of Patent: Nov. 21, 2000

[54] APPARATUS FOR RELEASING, THEN FIRING PERFORATING GUNS

[75] Inventors: Timothy W. Sampson, Spring, Tex.; Wilfred Schexnayder, Lafayette, La.; Colby W. Ross, Spring, Tex.

[73] Assignee: Baker Hughes Incorporated, Houston, Tex.

[21] Appl. No.: 09/183,177

[22] Filed: Oct. 30, 1998

[51] Int. Cl.[7] ..... E21B 29/02

[52] U.S. Cl. ..... 166/297; 166/55; 175/4.53; 175/4.56

[58] Field of Search ..... 166/297, 298, 166/55, 55.1; 175/4.53, 4.56

[56] References Cited

U.S. PATENT DOCUMENTS 3,990,507 11/1976 Vann ..... 166/55.1
4,526,233 7/1985 Stout ..... 166/377
5,115,865 5/1992 Carisella et al. ..... 166/55.1
5,462,117 10/1995 Green et al. ..... 166/55.1
5,509,481 4/1996 Huber et al. ..... 166/55.1
5,680,905 10/1997 Green et al. ..... 175/4.54

*Primary Examiner*—Eileen D. Lillis
*Assistant Examiner*—John Keck
*Attorney, Agent, or Firm*—Duane, Morris & Heckscher

[57] ABSTRACT

A perforating gun can be conveyed on tubing and fired while disconnected from the tubing. The gun is retained to a running tool at the lower end of the tubing in a locked position. Actuating a plunger by pressure, a weight bar or other techniques, breaks a rupture disc and allows use of hydrostatic pressure to stroke a piston and defeat the lock between the gun and the running tool. Upon exposure of ports on the gun to wellbore hydrostatic due to movement out of the running tool, the firing sequence in the gun is initiated. The weight of the gun, as well as hydrostatic or applied pressure in the wellbore, drives the perforating gun out of the running tool.

23 Claims, 15 Drawing Sheets

APPARATUS FOR RELEASING, THEN FIRING PERFORATING GUNS

FIELD OF THE INVENTION

The field of this invention relates to techniques for firing perforating guns downhole without damage to the conveyance for the gun downhole.

BACKGROUND OF THE INVENTION

When perforating guns are fired downhole, particularly when conveyed on tubing, extreme shock loads are applied to the tubing string at the time the gun or guns are fired. These shock loads can prevent release of the guns from the tubing string and can complicate the withdrawal of the tubing string after firing. Conventional techniques for firing tubing-conveyed perforating guns involve firing the guns while attached to the tubing string. Typical of such applications are U.S. Pat. No. 5,680,905. More recently, a tool has been developed by Schlumberger which releases from the tubing string as it fires. Thus, the prevailing methods described above have a significant drawback in that the shock loads of the gun firing are transmitted to the conveying tubing string if the gun and tubing string are in any way securely attached at the time of firing.

One of the objectives of the present invention is to ensure that the gun is physically detached from the conveying tubing string at the time that it is fired. In that way, any shocks from the gun are not conveyed into the tubing. There are no issues of difficulty of removal of the tubing. The gun is simply dropped and fires as it clears the portion of the tubing string which had previously supported it. Another objective of the present invention is to initiate the firing sequence in a variety of ways, with the preferred techniques being applied pressure and dropping of a weight bar. Those and other advantages of the invention will be appreciated by those skilled in the art by reviewing the preferred embodiment described below.

SUMMARY OF THE INVENTION

A perforating gun can be conveyed on tubing and fired while disconnected from the tubing. The gun is retained to a running tool at the lower end of the tubing in a locked position. Actuating a plunger by pressure, a weight bar or other techniques, breaks a rupture disc and allows use of hydrostatic pressure to stroke a piston and defeat the lock between the gun and the running tool. Upon exposure of ports on the gun to wellbore hydrostatic due to movement out of the running tool, the firing sequence in the gun is initiated. The weight of the gun, as well as hydrostatic or applied pressure in the wellbore, drives the perforating gun out of the running tool.

DETAiLED DESCRIPTION OF THE PREFERRED EMBODIMENT

Figure 1A:
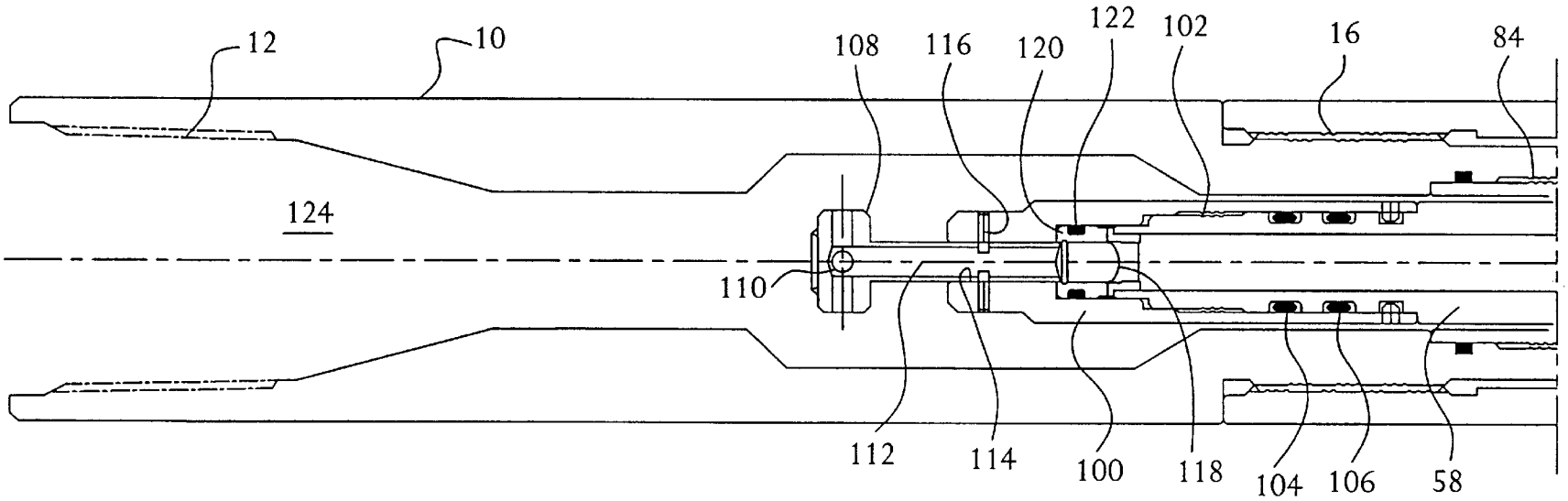
FIGS. 1*a–e* are a sectional view of the apparatus in the run-in position.
Figure 1B:
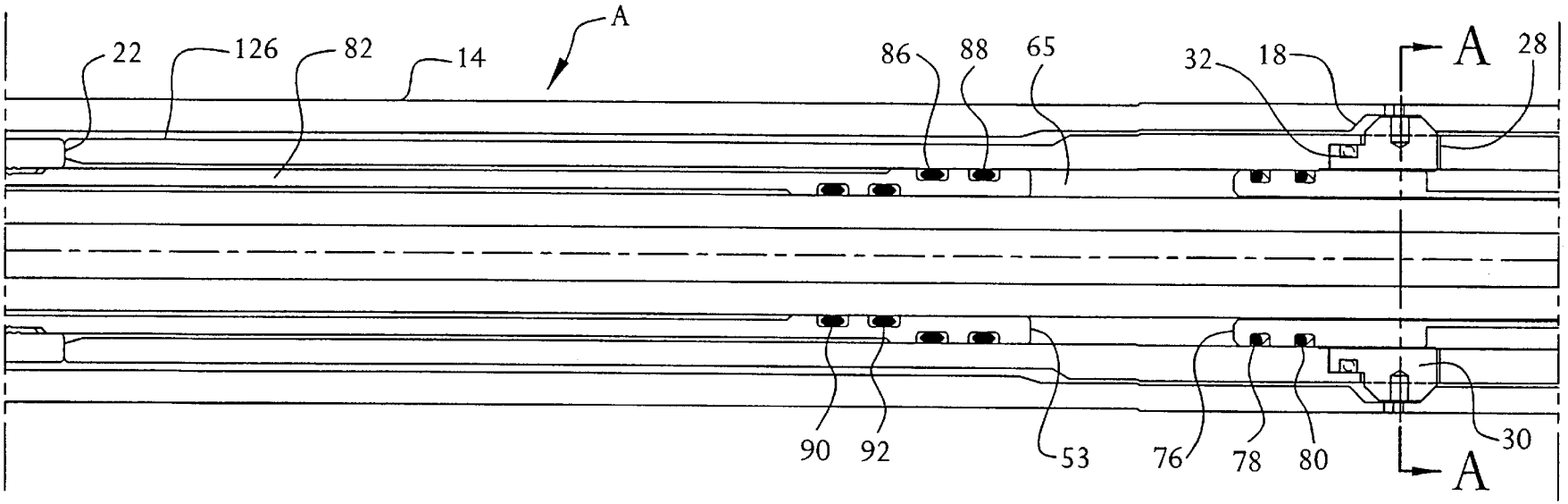
Figure 1C:
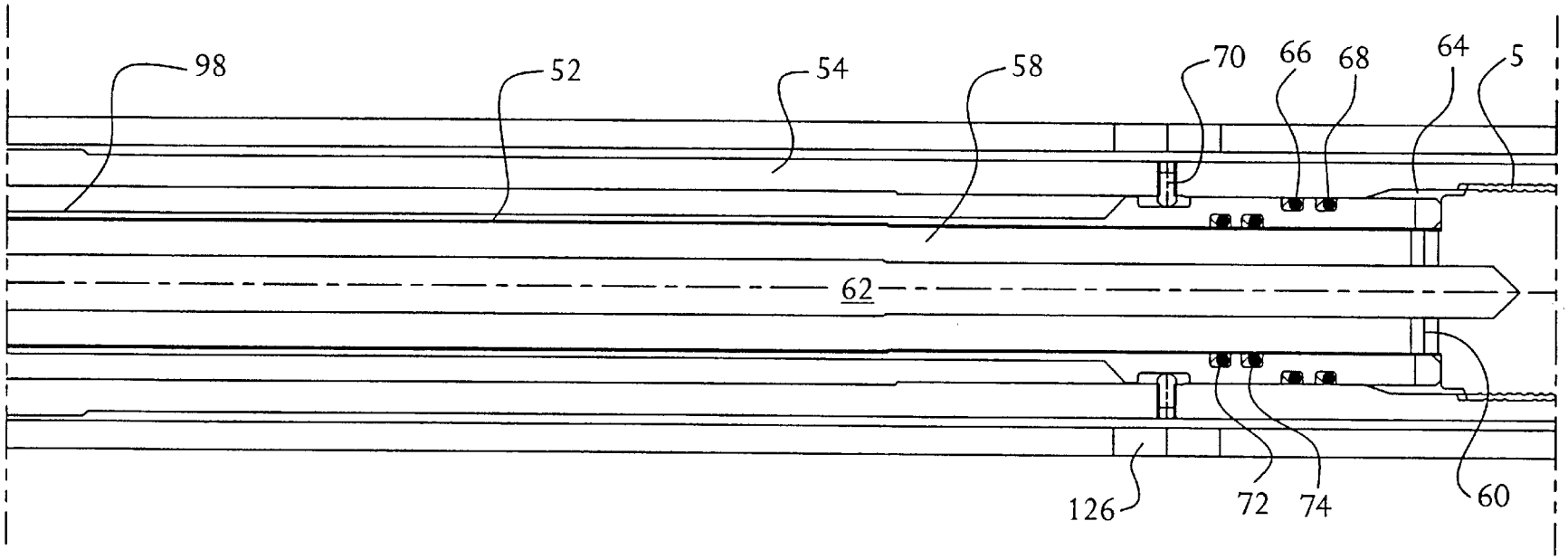
Figure 1D:
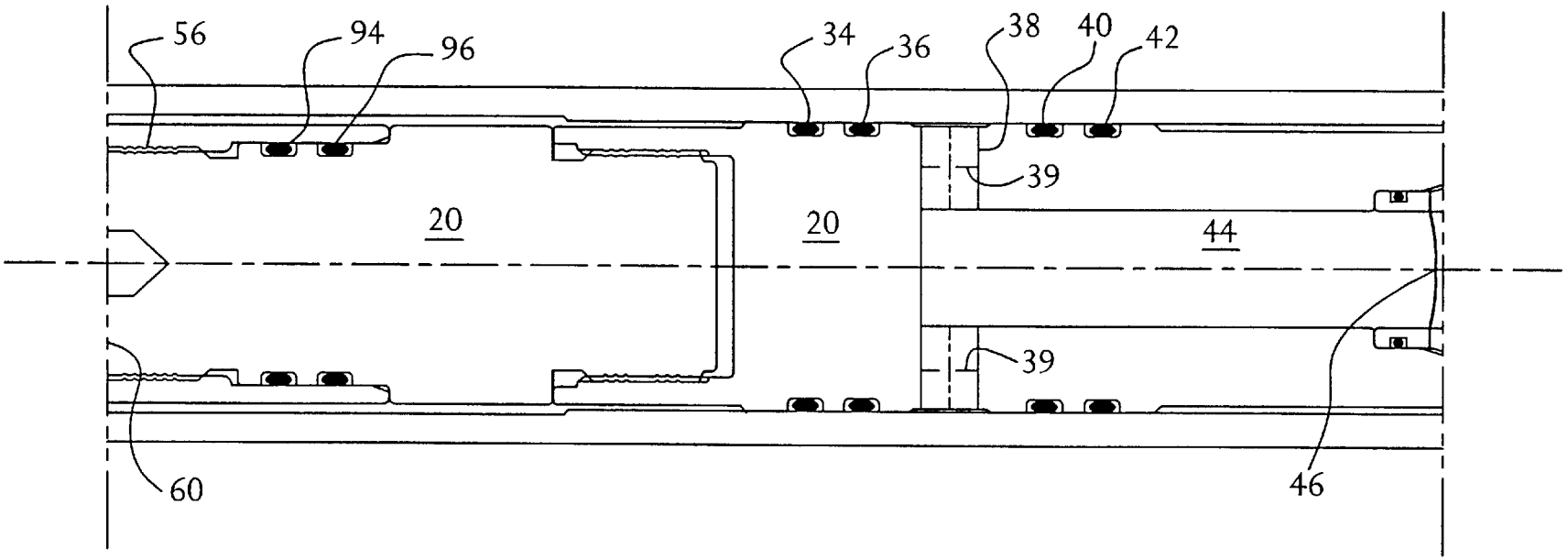
Figure 1E:
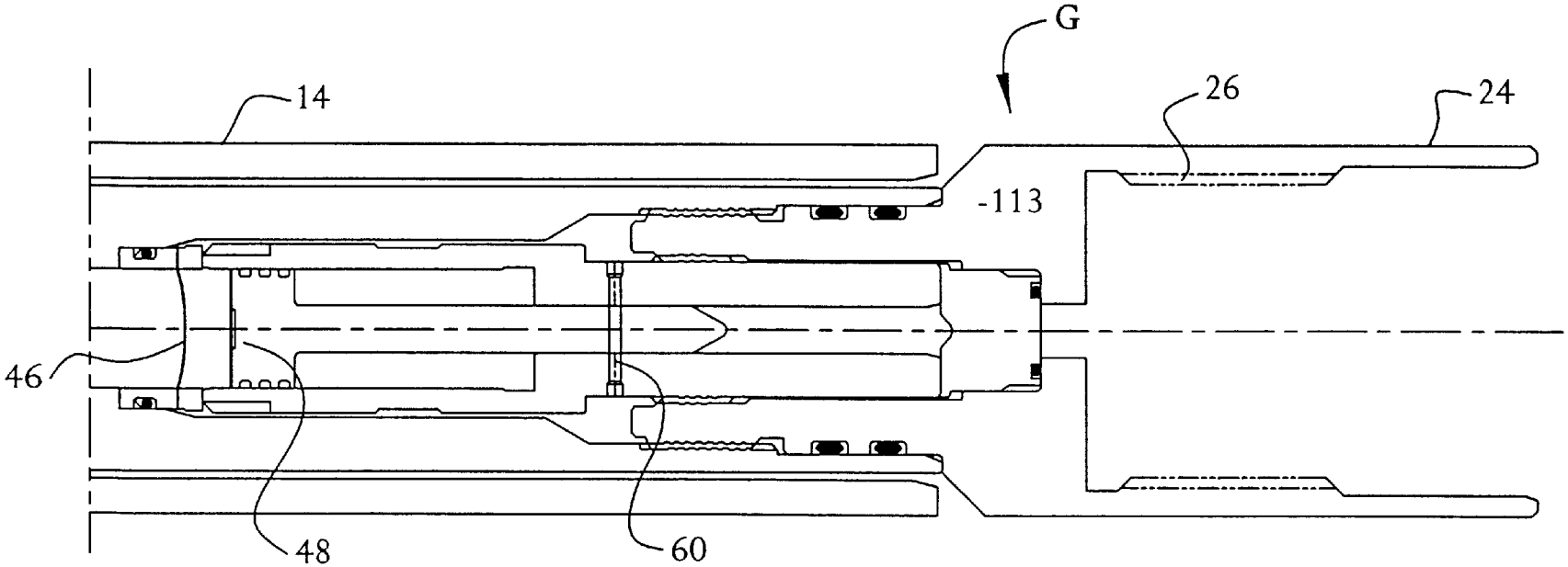

Referring to FIG. 1, the apparatus A has a top sub 10 connected at thread 12 to a tubing string or coiled tubing (not shown). Extending from top sub 10 is retaining sleeve 14, which is connected at thread 16. Retaining sleeve 14 has an internal groove 18 shown in FIG. 1*b*. The perforating gun G, partially shown in FIG. 1, has an upper body 20 having an upper end 22 (see FIG. 1*b*), and a lower end 24 (see FIG. 1*e*). The remainder of the gun G is connected below lower end 24 at thread 26 and is not shown. The portion of upper body 20 adjacent the upper end 22 is a sleeve with a window 28, through which extends dog or dogs 30. The dogs 30 are pulled radially inward by a garter spring 32.

Upper body 20 also has seal rings 34 and 36 above an opening 38 and further seal rings 40 and 42 below opening 38. Thus, in the position shown in FIG. 1*d*, the opening or openings 38 are effectively sealed against the retaining sleeve 14. Openings 38 lead to passage 44 which is in fluid communication with a breakable member, such as a rupture disc 46. "Rupture disc" is defined broadly as any device that prevents flow and upon certain conditions permits flow so that it includes members that break, dissolve, or move so that a valve member is also within the definition. A hammer 48 is sealingly retained in passage 44 by shear pin 50. Those skilled in the art will appreciate that actuating of the gun G occurs when the rupture disc 46 breaks and hydrostatic pressure in the wellbore acts on hammer 48, driving it down to break the shear pin 50 to set off the gun G. Accordingly, the details of the mechanism for shooting the gun G, beyond stating that it is hammer-actuated, will not be explained in detail because it is known to those of ordinary skill in this art. The time it takes to break the rupture disc 46 can be varied by sizing the opening or openings 38 to restrict flow, or by adding a restriction such as an orifice 39.

The apparatus A further includes a piston 52 disposed between an outer tubular extension 54 of the upper body 20 of gun G,. The outer tubular extension 54 is attached at thread 56. An inner tubular extension 58 extends from the upper body 20 and defines ports 60, which allow fluid communication from an internal passage 62 to an annular passage 64 where the piston 52 is disposed. Piston 52 has seals 66 and 68 to seal between the piston 52 and the outer extension 54. A shear pin 70 initially retains the piston 52 to the outer extension 54. Seals 72 and 74 seal between the piston 52 and the inner tubular extension 58.

At its upper end 76, the piston 52 has seals 78 and 80 to seal against outer extension 54. A sleeve 82 attached at thread 84 has seals 86 and 88 to seal against the outer extension 54 and seals 90 and 92 to seal against the inner tubular extension 58, thereby closing off the annular passage 65. At the opposite end of piston 52 at annular passage 64, seals 94 and 96 seal the connection at thread 56 to outer extension member 54.

Figure 2A:
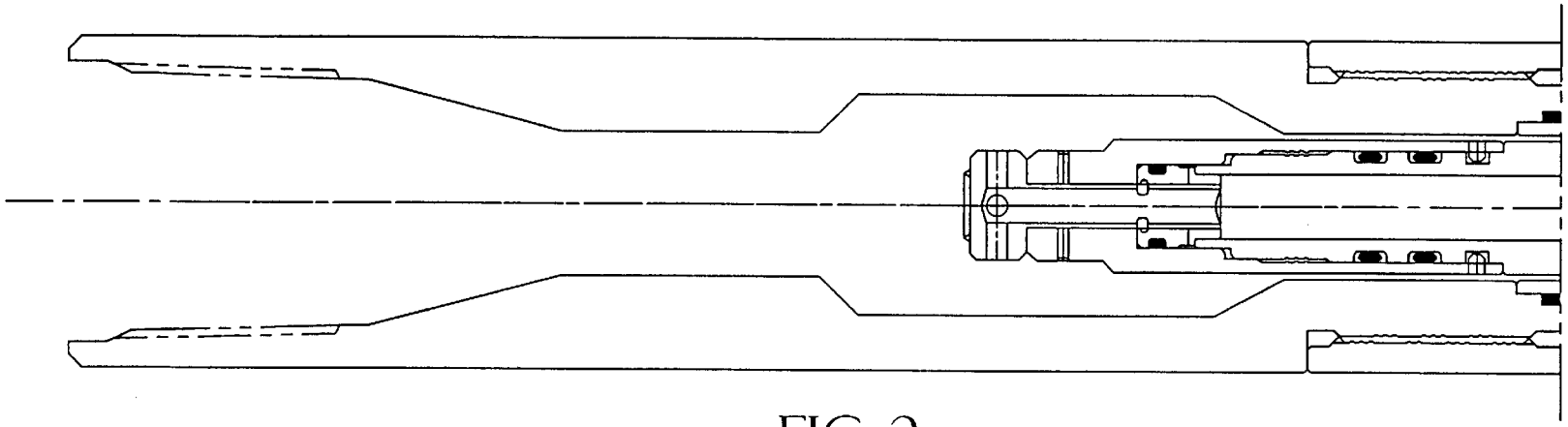
FIGS. 2*a–e* are the view illustrated in FIGS. 1 *a–e,* with the locking dogs unsupported and the gun ready to drop.
Figure 2B:
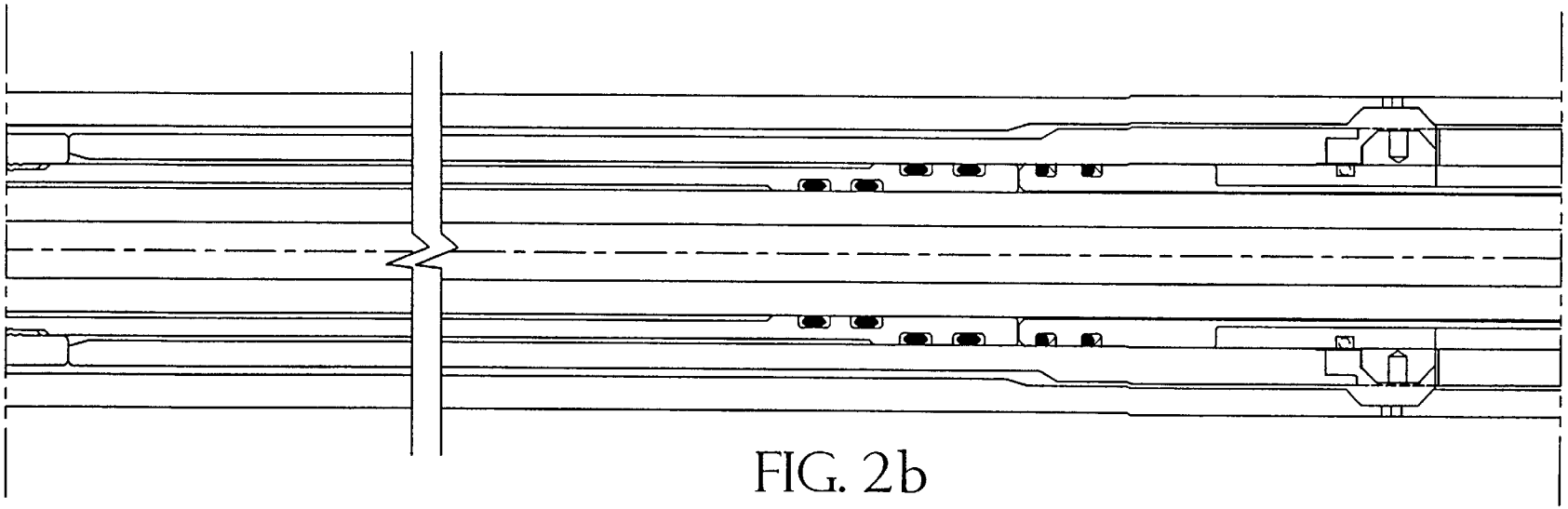
Figure 2C:
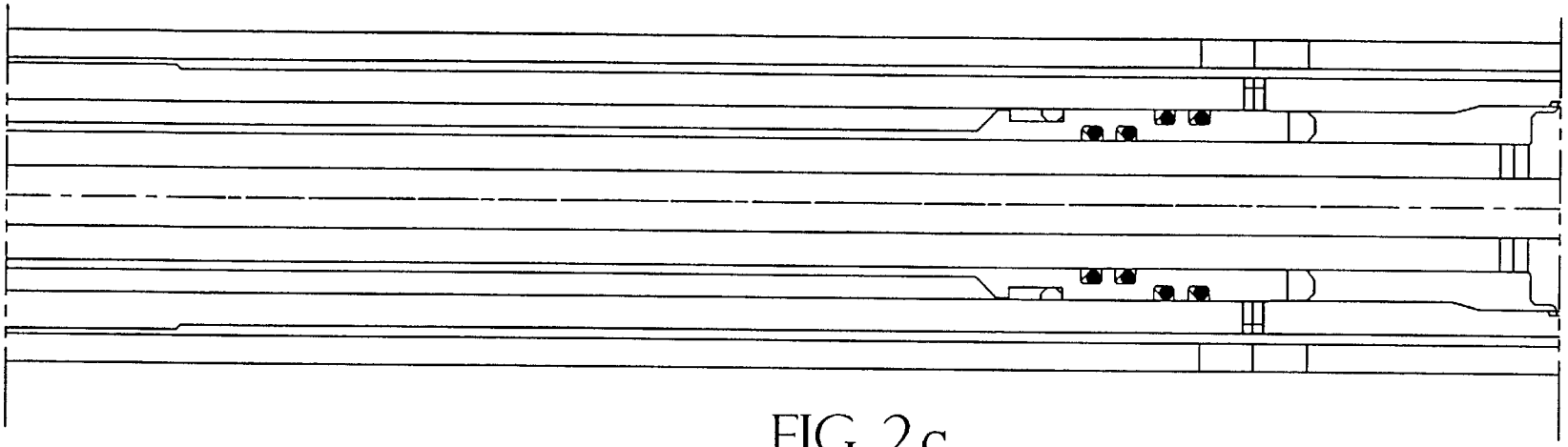
Figure 2D:
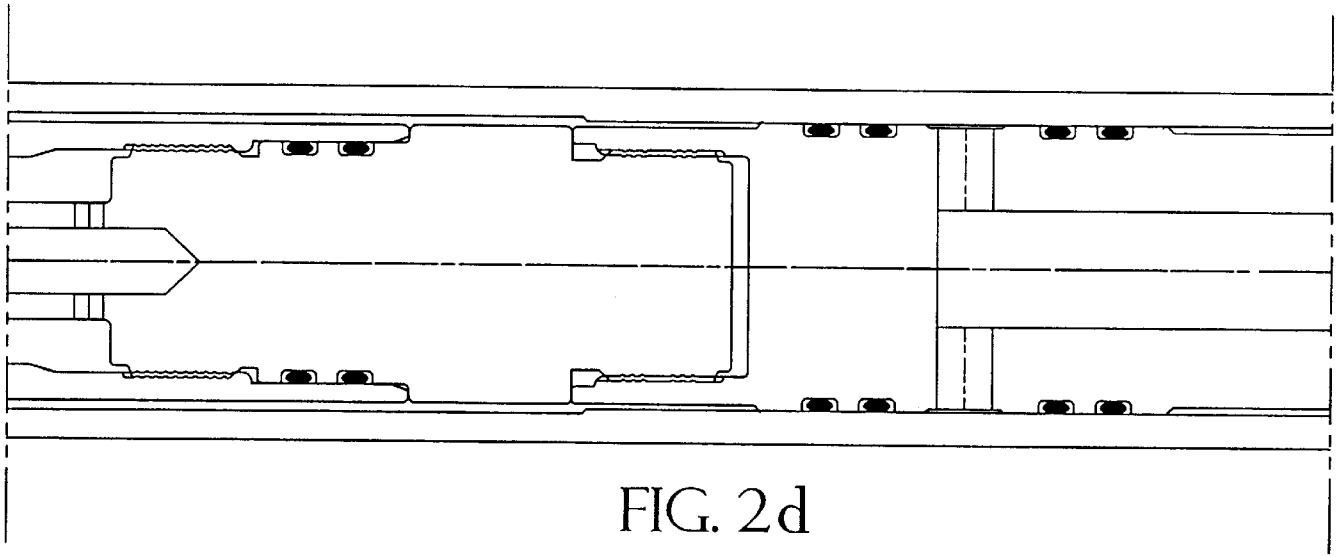
Figure 2E:
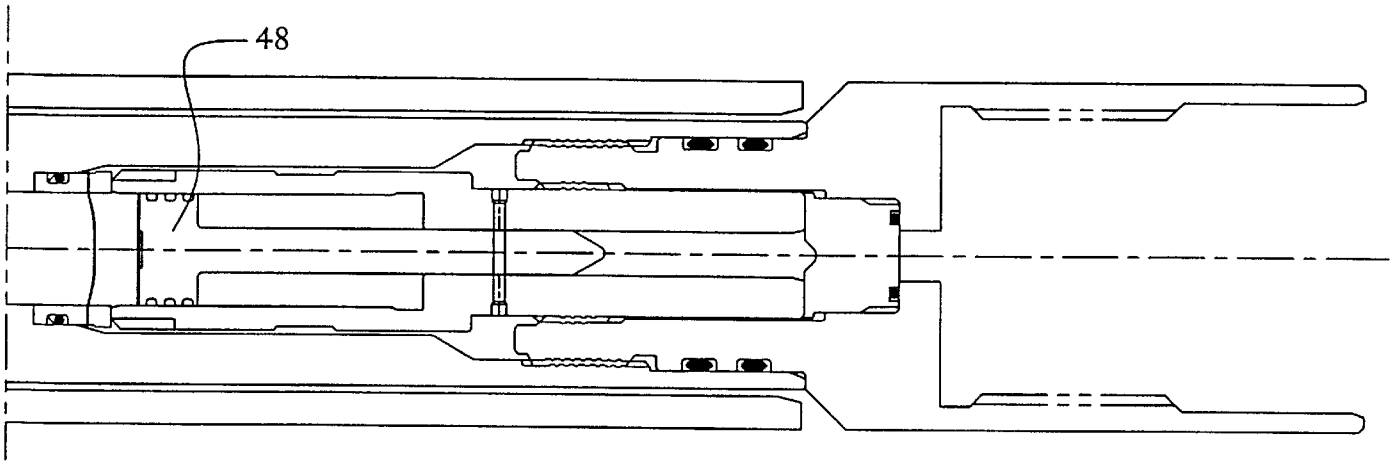
Figure 3A:
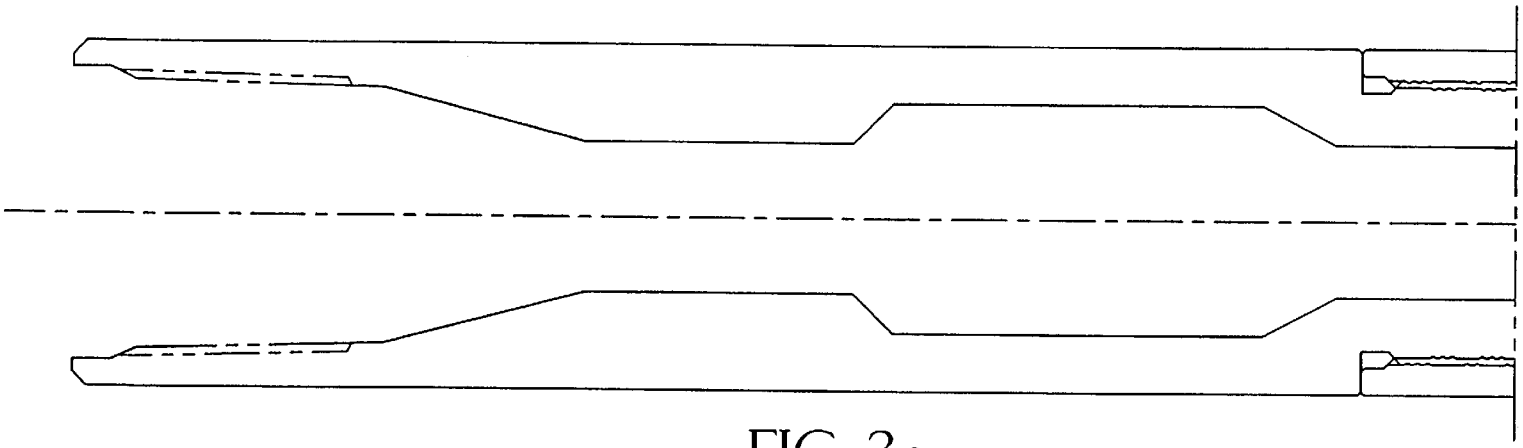
FIGS. 3*a–f* illustrate the view with the ports on the gun sufficiently clear of the tool so that it can fire.
Figure 3B:
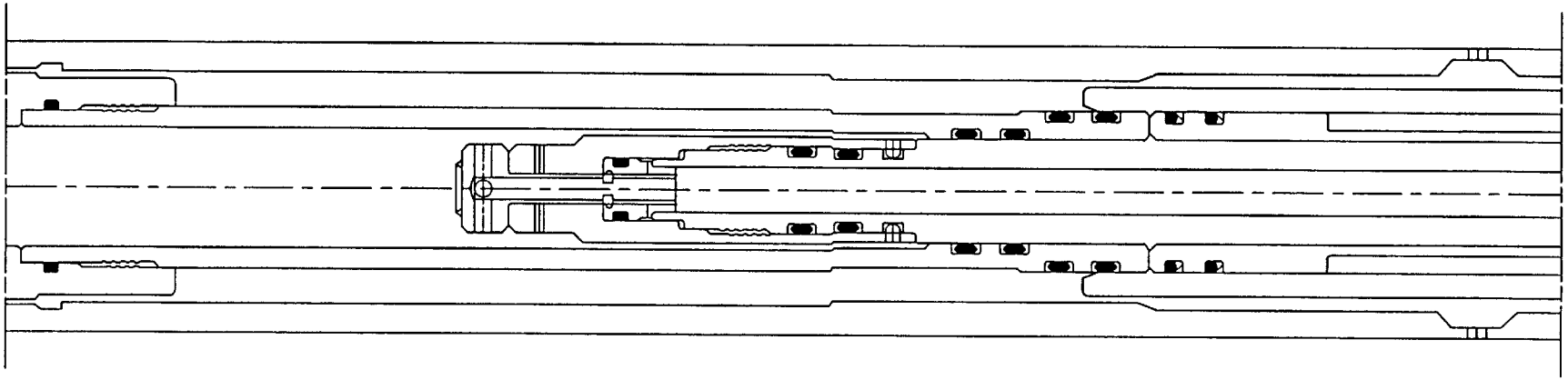
Figure 3C:
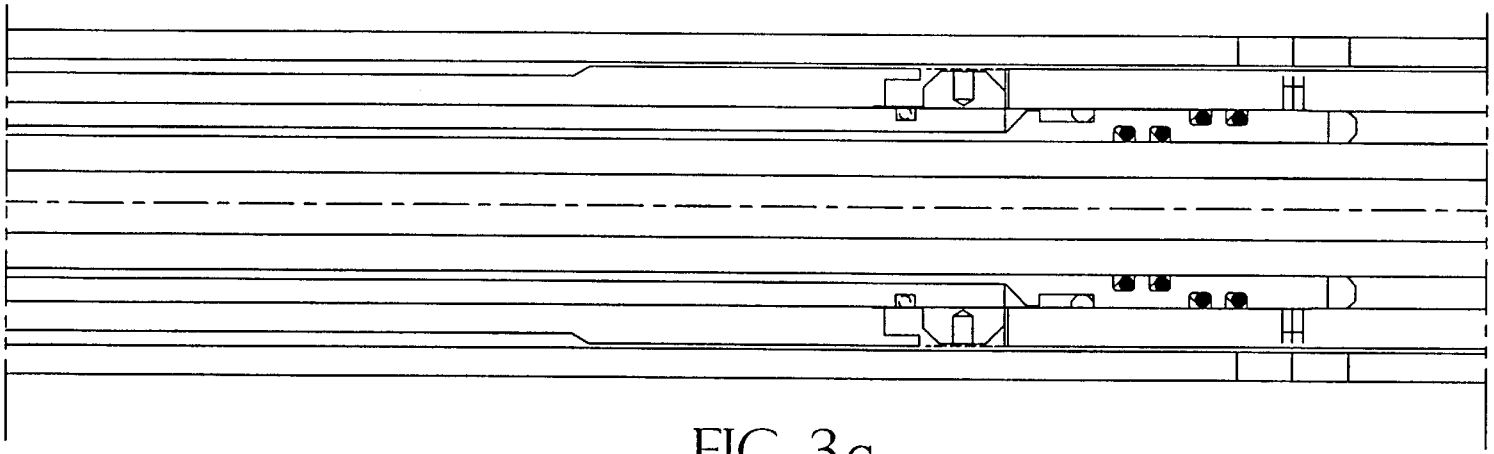
Figure 3D:
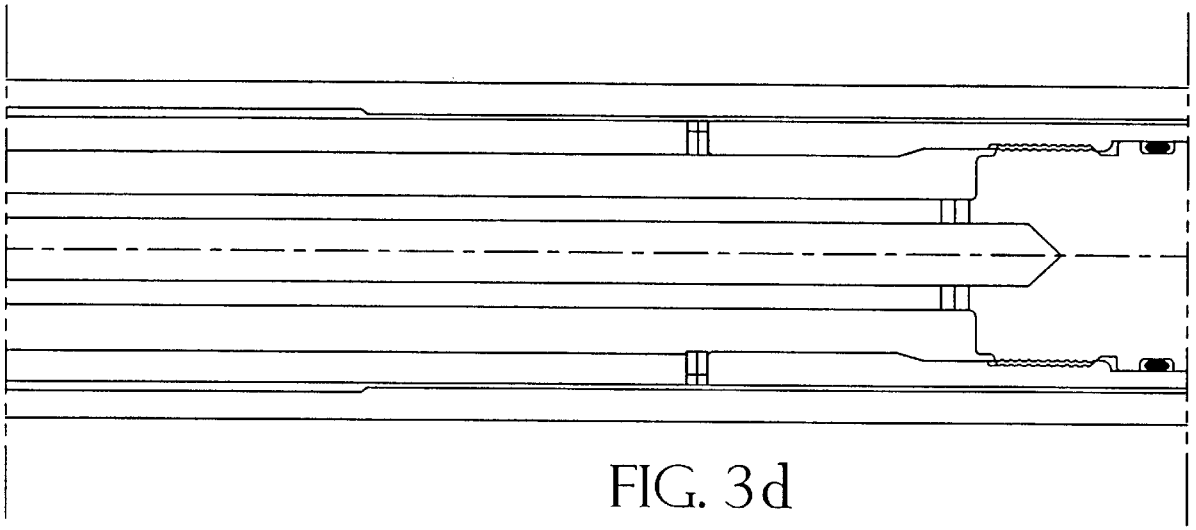
Figure 3E:
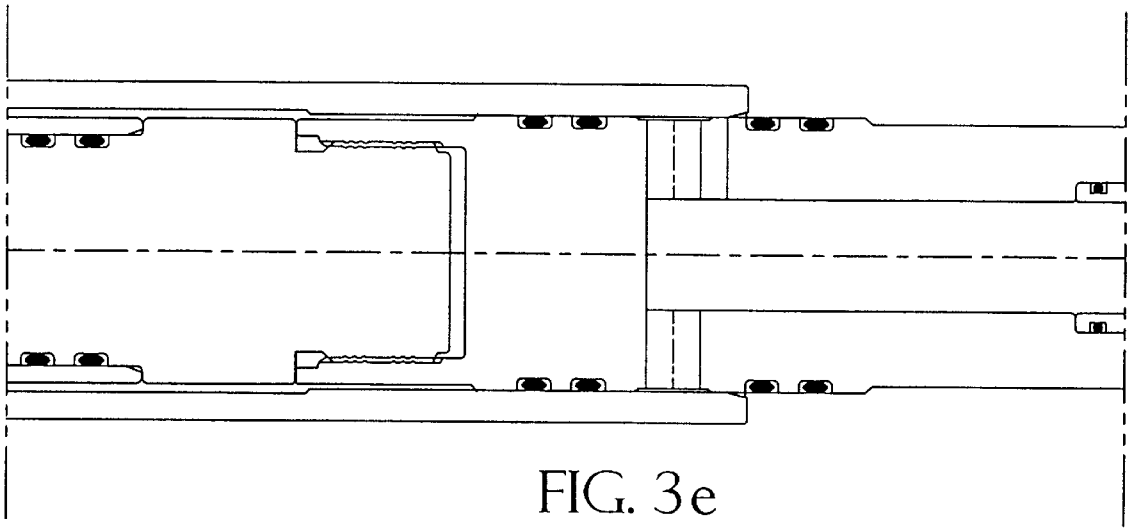
Figure 3F:
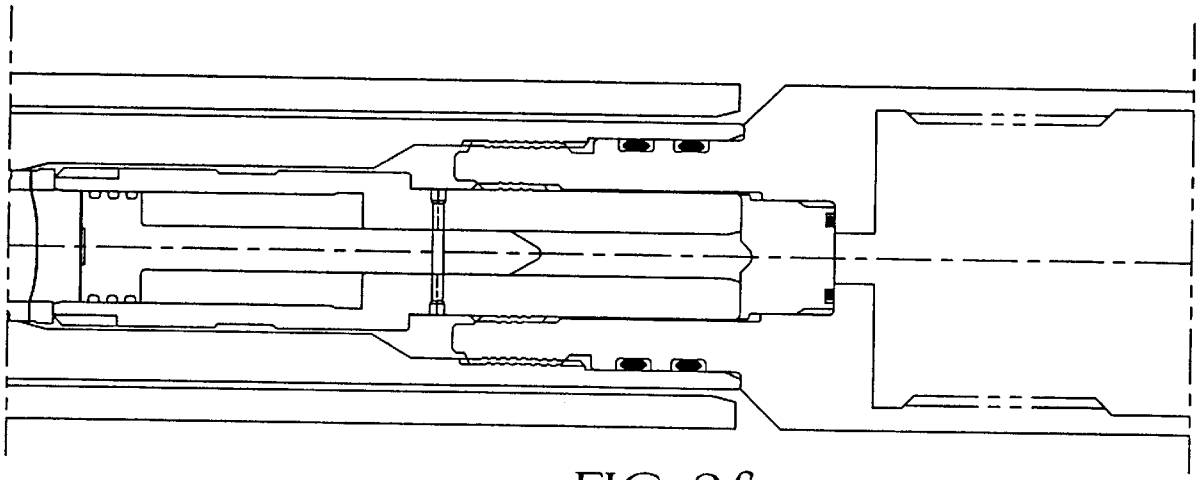
Figure 4A:
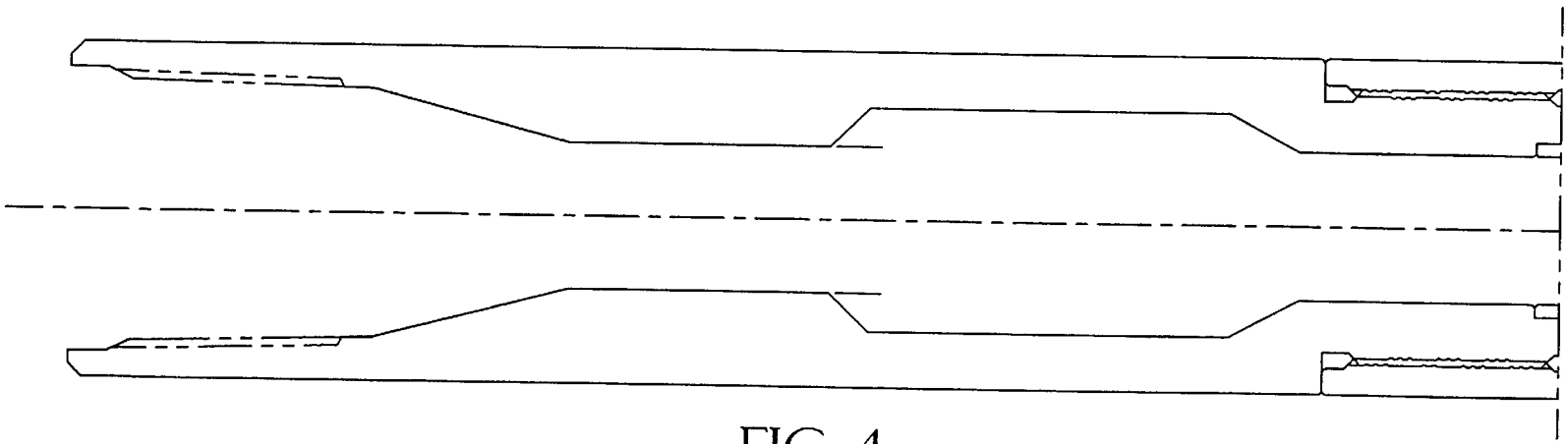
FIGS. 4*a–e* illustrate the apparatus with the gun dropped.
Figure 4B:
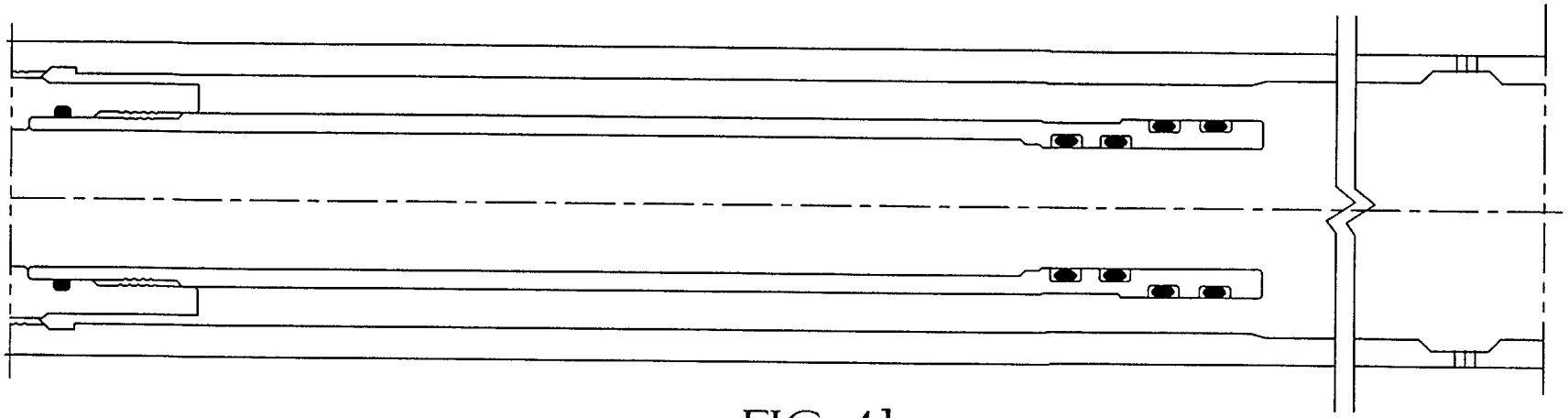
Figure 4C:
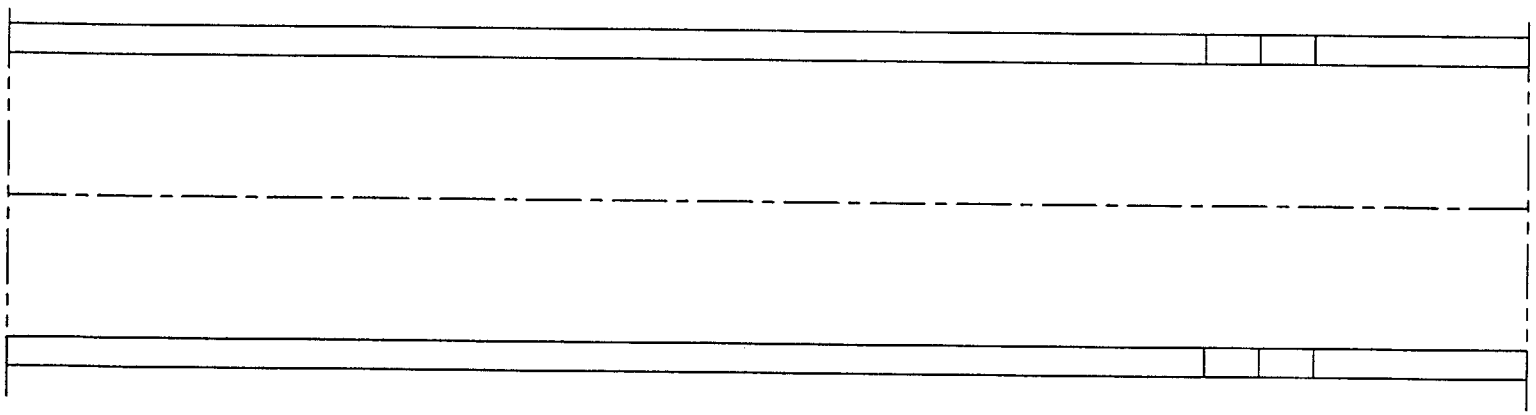
Figure 4D:
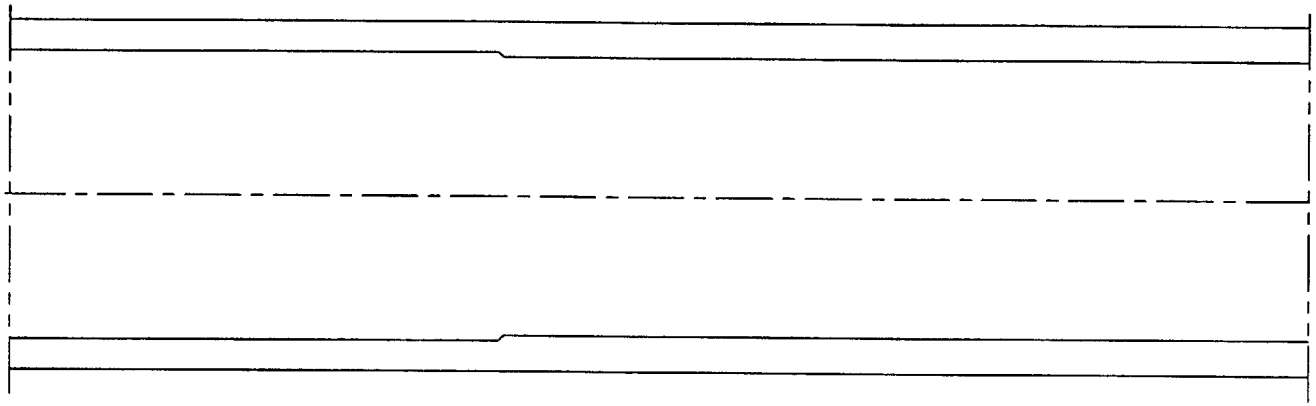
Figure 4E:
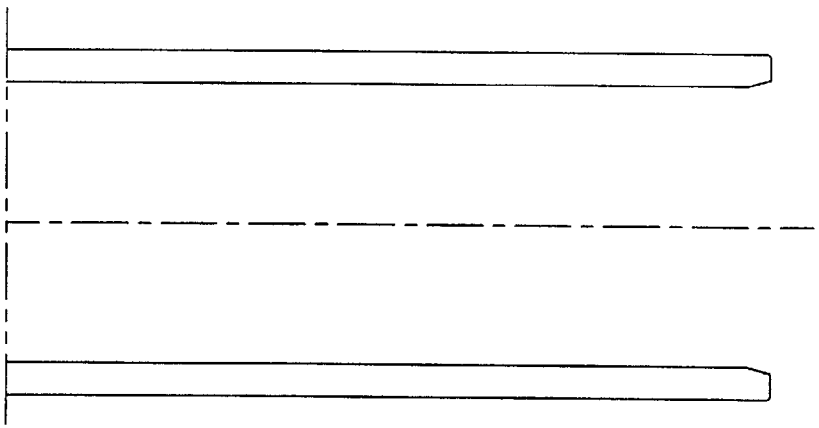
Figure 5A:
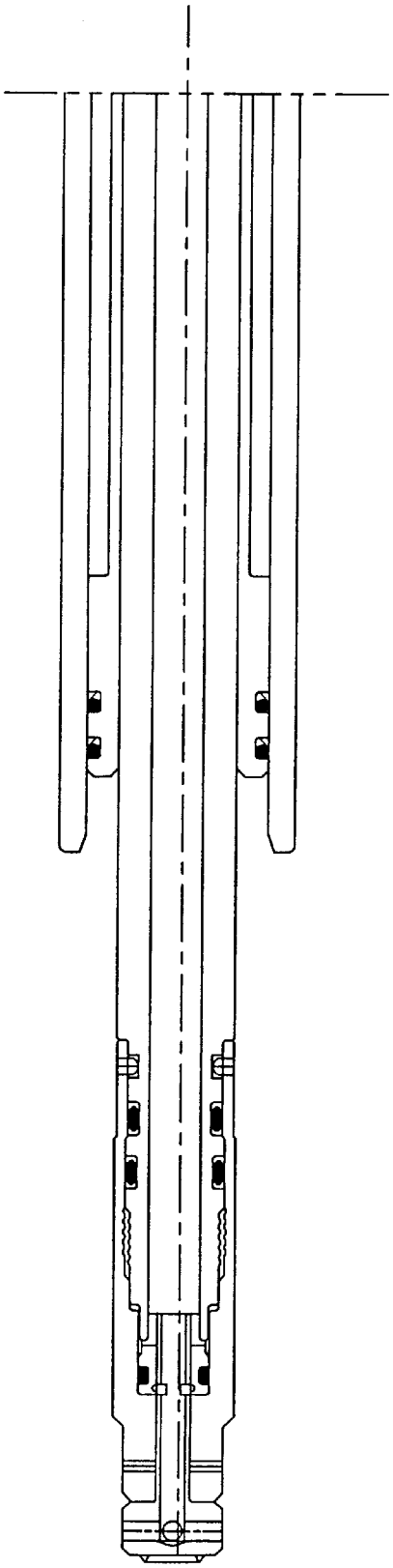
FIGS. 5*a–e* illustrate the gun after it drops and after it has fired.
Figure 5B:
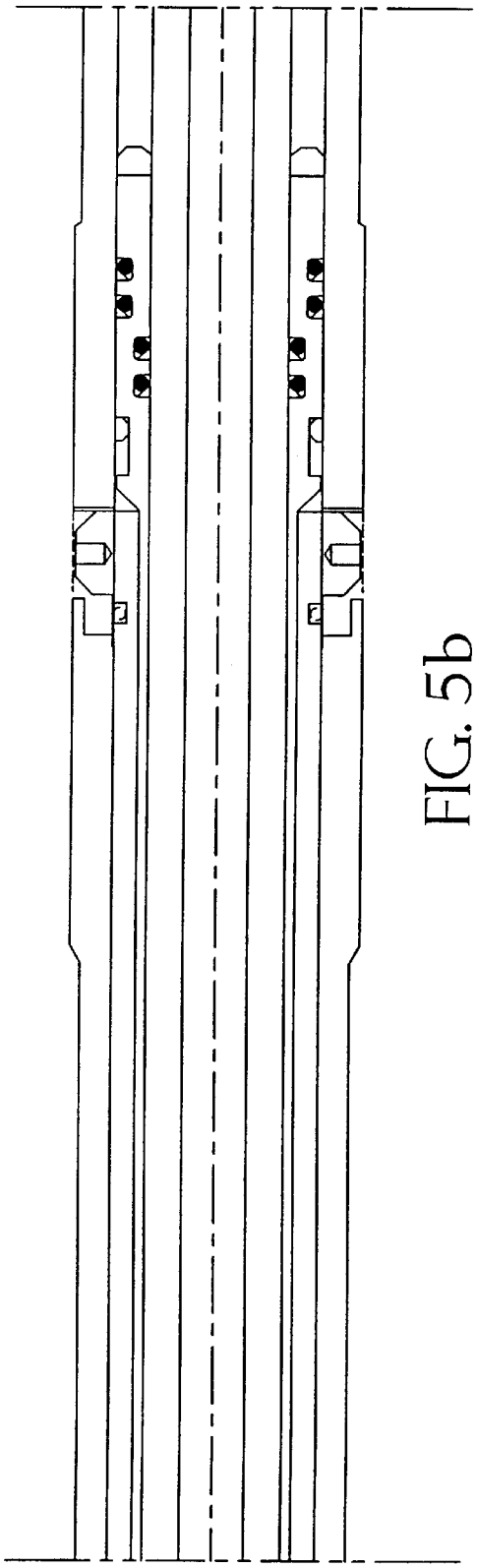
Figure 5C:
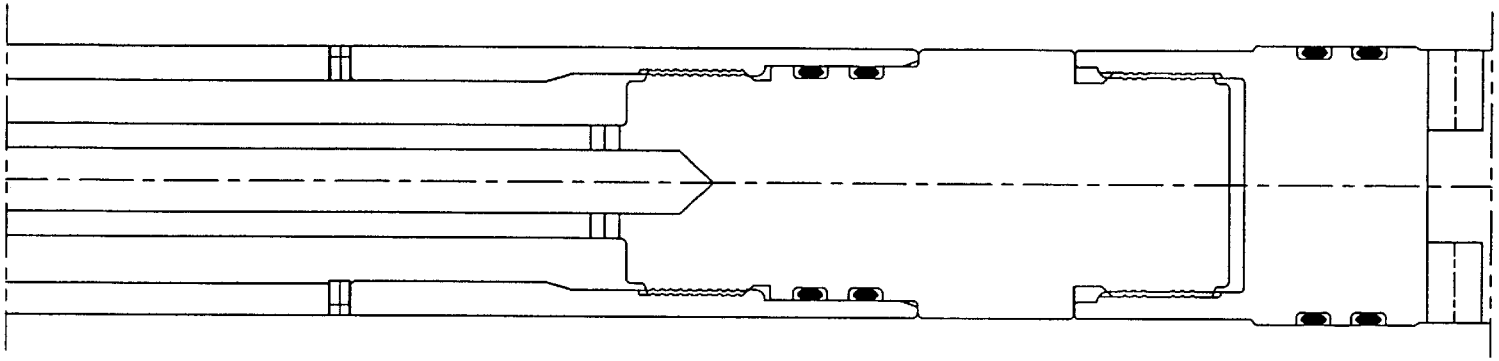
Figure 5E:
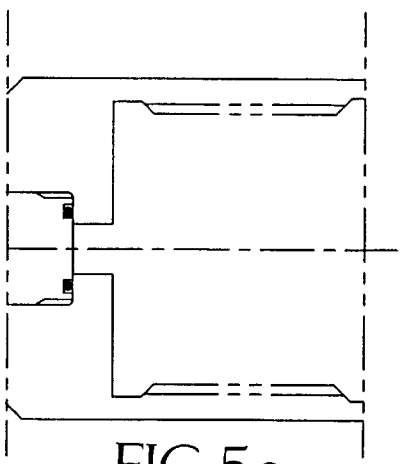
Figure 5D:
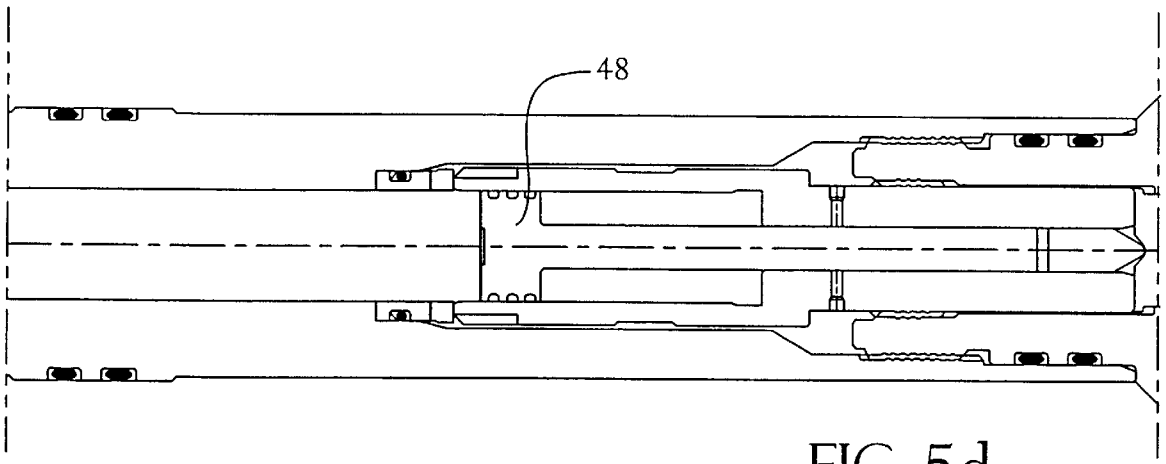

Piston 52 has a recessed surface 98 which, when presented opposite the dogs 30, allows them to be pulled radially inwardly by the garter spring 32 to take them out of groove 18, as shown in FIG. 2*b*.

Referring now to FIGS. 1*a* and *b,* the inner tubular extension 58 is connected to a closure member 100 at thread 102, with the connection sealed by seals 104 and 106. A plunger 108, having an inlet 110 and a passage therethrough 112, extends through an opening 114 in closure member 100. A shear pin or pins 116 hold the plunger 108 with respect to the closure member 100. A breakable member, such as a rupture disc 118, is held by a retainer 120 with a peripheral seal 122. Those skilled in the art will appreciate that when the plunger 108 is actuated by dropping a weight bar, in the preferred embodiment, its downward movement will break the shear pins 116 and ultimately the rupture disc 118, thus creating a clear flow passage from passage 124 through passage 62 and ports 60 into annular passage 64. Rupture disc 118 can also be broken by applied pressure through passage 112. As previously stated, annular passage 64 is effectively sealed off and contains atmospheric pressure until such time as plunger 108 is actuated to move downwardly. When plunger 108 moves downwardly, the hydrostatic pressure in passage 124 acts on piston 52 to drive the piston 52 upwardly against the atmospheric pressure trapped in annular passage 65. Thus, the pressure in annular passage 64 builds up on piston 52 and is opposed only by the atmospheric pressure in annular passage 65. The pressure imbalance on piston 52 results in the breakage of shear pin 70 and the upward movement of piston 52 (until it hits surface 53) to place recessed surface 98 opposite dogs 30, as shown in FIGS. 2*b* and *c*. At this time, the dogs 30 are pulled inwardly by garter spring 32. Passage 65 is still around atmospheric pressure due to seals 78, 80, 86, 88, 90, and 92. The net underbalanced force on piston 52, when against the travel stop 53, puts a net downward force on the upper body 20 to push it out of sleeve 14. At this time, the weight of the gun G will also move it out of the retaining sleeve 14. The hydrostatic pressure in annular space 126 will also exert a downward force on the upper end 22 of the upper body 20 on gun G. Thus, there is a combined force of hydrostatic pressures acting on gun G as well as its own weight that will drive it out of retaining sleeve 14. Referring to FIG. 3, it can be seen that this movement has begun to occur with the seals 40 and 42 now having been displaced beyond the lower end of the retaining sleeve 14 to allow pressure buildup in passage 44 so that the next thing that happens is the breakage of the rupture disc 46, which will set off the gun. How long this takes, and therefore the position of the gun with respect to sleeve 14, is determined by the pressure differential through ports 38, which is a function of the depth, the density of the well fluids, and the area of the ports 38 or restrictors 39. The gun G can fire when some of it is still in sleeve 14 or later. The important thing is that it doesn't fire until after it is released from sleeve 14 by the dogs 30. FIG. 5 illustrates the gun in the fired position, indicating the movement of the hammer 48 to set off the gun after the breakage of the rupture disc 46. FIGS. 4*a–e* illustrate the remaining components after the gun G has dropped out.

Referring again to FIG. 1*c*, it should be noted that openings 126 allow well fluids to enter the retaining sleeve 14 as the gun G moves downwardly.

Those skilled in the art will appreciate that while the preferred embodiment for actuation of the plunger 108 is to pressurize passage 124, or drop a rod on plunger 108, other techniques can be employed to actuate plunger 108 without departing from the spirit of the invention. In fact, a plunger such as 108 does not even need to be used as long as there is a technique for selectively allowing hydrostatic pressure into passage 62 when the apparatus A is at the desired location. Those skilled in the art will also appreciate that as soon as the gun G begins to drop down and reaches the position shown in FIG. 3*e*, the gun G will actuate almost instantaneously. As previously stated, any delay can be factored in by design of ports 38 or restrictions 39. Thus, the distance represented by arrow 126 (see FIGS. 3*e* and *f*) represents the distance the gun G must fall or be pushed before it can fire. This distance is, of course, factored in to ensure that the perforating occurs at the proper depth.

Those skilled in the art will appreciate that various types of signals sent from the surface downhole can be used to break the rupture disc 118. Alternatively, other devices that selectively close off passage 62 can be used, coupled with signals from the surface to actuate them. The signals can be electrical, acoustical, or fibre optic. Additionally, a mechanical design of the valve mechanism to replace the rupture disc 118 can be used so that actuation can occur from the surface with either a shifting tool run through tubing, or dropping balls on seats to move a sleeve, or in any one of a variety of ways to selectively provide access of hydrostatic pressure in the tubular to the passage 62.

The apparatus A of the present invention thus eliminates shock loads to the tubing connected at thread 12 because at the time the gun fires, it has either cleared or for the most part cleared the retaining sleeve 14 and is certainly no longer rigidly connected to the tubing string connected to thread 12. Accordingly, the problems in retrieval of the assembly above the gun and the attached tubing string are eliminated by the apparatus A of the present invention.

The foregoing disclosure and description of the invention are illustrative and explanatory thereof, and various changes in the size, shape and materials, as well as in the details of the illustrated construction, may be made without departing from the spirit of the invention.

What is claimed is:

1. A downhole perforating gun firing apparatus, comprising:

a running tool having a body;

a gun body having a firing assembly adjacent an upper end thereof selectively retained by said running tool body by a lock;

whereupon when said lock is unlocked without any firing of said firing assembly, said gun body is no longer supported by said running tool body and it falls with respect to said running tool body, said falling of said gun body with respect to said running tool body sufficiently to expose said firing assembly to downhole hydrostatic pressure, sets off said firing assembly without gun impact on a fixed object downhole.

2. The apparatus of claim 1, wherein:

said gun body is in contact with said running tool and dropping as said firing assembly actuates.

3. The apparatus of claim 1, wherein:

said gun body is out of contact with said running tool and dropping as said firing assembly actuates.

4. The apparatus of claim 1, wherein:

said running tool comprises a receptacle which is selectively engaged by said gun body in a manner where access to said firing asembly is prevented.

5. The apparatus of claim 4, wherein:

said gun body having an access port to said firing assembly, said access port sealed closed when said gun body is engaged to said receptacle, whereupon release of said gun body said access port is relocated so that access to said firing assembly detonates the gun.

6. The apparatus of claim 5, wherein:

said firing assembly is initially exposed to a pressure below wellbore hydrostatic pressure, whereupon movement of said gun body, the higher hydrostatic pressure detonates the gun.

7. The apparatus of claim 6, wherein:

said port is sized to time the rate of pressure buildup to control the time delay of firing of said firing assembly from the time when said access port is opened.

8. The apparatus of claim 7, wherein:

said gun body is in contact with said running tool and dropping as said firing assembly actuates.

9. The apparatus of claim 7, wherein:

said gun body is out of contact with said running tool and dropping as said firing assembly actuates.

10. The apparatus of claim 4, wherein:

said gun body is held to said receptacle by a dog extending through a window in an external tubular extension of said gun body while engaging a recess in said receptacle.

11. The apparatus of claim 1, wherein:

said gun body is urged to move out of contact with said running tool when said lock is unlocked due to a combination of its own weight and hydrostatic pressure creating an unbalanced force on said gun body.

12. A downhole perforating gun firing apparatus, comprising:

a running tool having a body;

a gun body having a firing assembly selectively retained by said running tool body by a lock;

whereupon when said lock is unlocked, said gun body moves with respect to said running tool body in order to actuate said firing assembly;

said running tool comprises a receptacle which is selectively engaged by said gun body in a manner where access to said firing assembly is prevented;

said gun body is held to said receptacle by a dog extending through a window in an external tubular extension of said gun body while engaging in recess in said receptacle;

an internal tubular extension of said gun body to define an annulus between itself and said external tubular extension;

a piston in said annulus movable from a first position where it holds said dog to said recess and a second position where it allows said dog to move out of said recess.

13. The apparatus of claim 12, wherein:

said internal tubular extension defines a passage which communicates to said annulus on one side of said piston;

said passage selectively sealed against wellbore hydrostatic pressures by a removable barrier;

said piston defining a closed portion of said annulus which contains pressure at a level substantially below hydrostatic pressure in the wellbore;

whereupon removal of said barrier, an unbalanced force from wellbore hydrostatic pressure now applied through said passage moves said piston to undermine support for said dog.

14. The apparatus of claim 13, wherein:

said dog is biased away from said recess;

said removable barrier comprises a rupture disc.

15. The apparatus of claim 14, wherein:

said rupture disc is broken to permit wellborn hydrostatic pressure to act on said piston by virtue of applied pressure in said running tool body.

16. The apparatus of claim 14, wherein:

said rupture disc is broken by an applied force to permit wellbore hydrostatic pressure to act on said piston.

17. The apparatus of claim 16, further comprising:

a plunger having a flowpath therethrough;

said plunger, when struck by an object, moves down to break said rupture disc and provide fluid communication to said flowpath toward said piston.

18. A method of firing a perforating gun having an upper end in a wellbore, comprising:

running in the gun on a running tool;

locating a firing mechanism for the gun adjacent said upper end;

releasing the gun so that it can drop from the running tool;

exposing said firing mechanism to wellbore hydrostatic pressure;

firing the gun as a result of said exposure to hydrostatic pressure.

19. The method of claim 18, further comprising:

providing a receptacle in the running tool;

locking the gun body to the receptacle for run-in;

covering up an access port to a firing assembly by the receptacle during run-in;

uncovering the access port as the gun moves out of the receptacle.

20. The method of claim 18, futher comprising:

using a combination of wellbore hydrostatic pressure and the weight of the gun to unlock the gun and separate it from the running tool.

21. A method of firing a perforating gun in a wellbore, comprising:

running in the gun on a running tool;

releasing the gun from the running tool;

firing the gun as it moves with respect to the running tool;

providing a receptacle in the running tool;

locking the gun body to the receptacle for run-in;

covering up an access port to a firing assembly by the receptacle during run-in;

uncovering the access port as the gun moves out of the receptacle;

using hydrostatic pressure through the uncovered port to fire the firing assembly.

22. A method of firing a perforating gun in a wellbore, comprising:

running in the gun on a running tool;

releasing the gun from the running tool;

firing the gun as a result of its movement with respect to the running tool;

providing a receptacle in the running tool, locking the gun body to the receptacle for run-in;

covering up an access port to a firing assembly by the receptacle during run-in;

uncovering the access port as the gun moves out of the receptacle;

using a dog trapped by a movable piston to selectively lock the gun body to the receptacle;

selectively isolating the piston from wellbore hydrostatic pressure until a barrier is broken;

applying an unbalanced force to the piston using wellbore hydrostatic pressure when the barrier is broken.

undermining the dog to release the gun body by moving the piston.

23. The method of claim 22, further comprising:

using a rupture disc to initially isolate a first end of the piston from wellbore hydrostatic pressure;

exposing a second end to a pressure below hydrostatic pressure;

breaking the rupture disc so that wellbore hydrostatic pressure strokes the piston to a travel stop;

using the piston when against the travel stop to separate said gun body from the receptacle.

* * * * *